US006109005A

United States Patent [19]

Fogle

[11] Patent Number: 6,109,005

[45] Date of Patent: Aug. 29, 2000

[54] METHOD OF PACKAGING A COILED TRIMMER LINE

[75] Inventor: John R. Fogle, Cave Creek, Ariz.

[73] Assignee: Robert L. Phillips, Scottsdale, Ariz.; a part interest

[21] Appl. No.: 09/374,720

[22] Filed: Aug. 13, 1999

[51] Int. Cl.[7] ..... B65B 17/00

[52] U.S. Cl. ..... 53/430; 206/459.5; 206/63.3

[58] Field of Search ..... 53/430, 471, 473, 53/478, 116; 206/388, 409, 471, 461, 463, 459.5, 63.3

[56] References Cited

U.S. PATENT DOCUMENTS

| | | | |
|---|---|---|---|
| 3,776,375 | 12/1973 | Rohdin | 206/45 |
| 5,086,914 | 2/1992 | Mish et al. | 206/63.3 |
| 5,769,224 | 6/1998 | Poncy et al. | 206/365 |
| 5,788,062 | 8/1998 | Cerwin et al. | 206/63.3 |

*Primary Examiner*—Peter Vo
*Assistant Examiner*—Hemant M. Desai
*Attorney, Agent, or Firm*—LaValle D. Ptak

[57] ABSTRACT

A method and apparatus for packaging coiled nylon copolymer trimmer line comprises making the package of plastic material which is capable of melt bonding, either by the application of heat and pressure, radio frequency (RF) or by ultrasonic welding. The container comprises a backing sheet and a pre-formed bubble having an opening in it, with a flange extending outwardly around the opening. The flange is placed on the backing sheet; and the two sheets are heat-melt bonded together by a suitable technique, to produce a strong, integral package which significantly resists separation of the flange from the backing sheet. After the package has been formed, nylon or nylon copolymer, or other plastic, trimmer line is wound into the package, and the bond between the flange and the backing sheet is greater than the compression spring force exerted by the wound trimmer line against the package, preventing separation of the package parts from one another.

4 Claims, 2 Drawing Sheets

FIG. 1
( Prior Art )
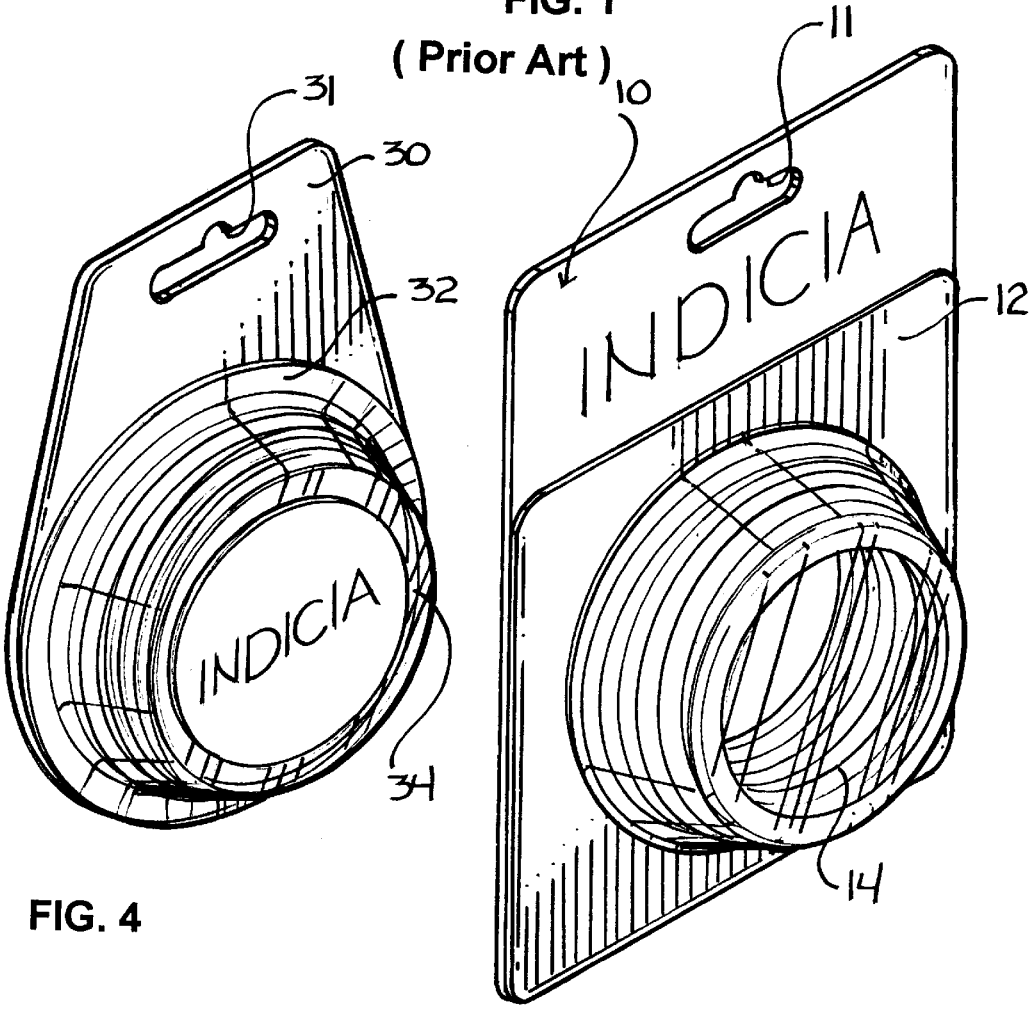
FIG. 4
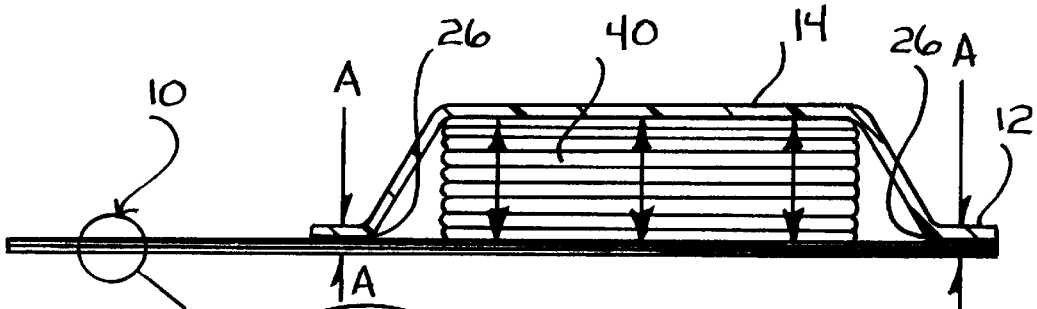
FIG. 2
( Prior Art )
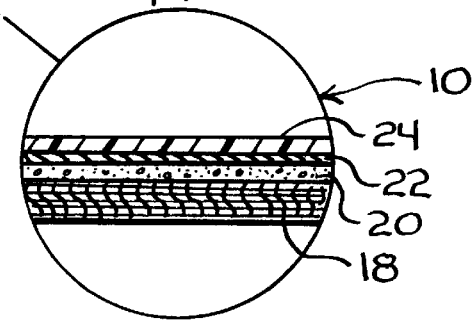
FIG. 3
( Prior Art )

METHOD OF PACKAGING A COILED TRIMMER LINE

BACKGROUND

Weed and grass trimmers using flexible cutting lines are in widespread use. Many of these trimmers employ a rotatable hub with a short length of nylon or copolymer nylon or other plastic line extending from the hub. When the hub is rotated, the tip of the line extending from the hub provides the cutting or trimming action. Grass and weed trimmers using this principle of operation have been popular for their versatility of use and because the flexible trim line is safer to use than rigid rotating steel blades.

Various types of trimmer devices have been developed for using such flexible trim lines. Typically, rotating line trimmers or string trimmers employ a line having a generally circular cross section. This line, in many trimmers, is wound on a storage reel in the hub of the device, and is played out of a hole in the hub in discrete amounts as the line breaks off or wears off. When the supply of line on the storage reel in the hub is used up, additional line is provided from a continuous length of line supplied as replacement line in a trimmer line package. The line which is provided in such packages typically is equal to the amount of line wound on a storage reel of the hub of a trimmer device, or it is in excess of the amount of line which can be wound on a hub, thereby providing more than one set of line replacements.

Generally, the trimmer line which is used in rotating string trimmers is manufactured or extruded of monofilament nylon or copolymer nylon material. The cross-sectional diameters of the line used in the trimmers vary from larger cross-sectional diameters for commercial trimmers to smaller diameters in the trimmers sold for intermittent home use. Even though different diameter line sizes are employed, the range of sizes is relatively narrow (typically, 0.050" to 0.155" in diameter). Trimmer lines which have cross sections other than circular cross sections have been developed in an attempt to provide sharper cutting edges at the point of impact when cutting grass or weeds. Cross-sectional configurations in the form of elongated ribbed lines, or a star-like cross section, or square, or triangular cross sections have been developed. The overall cross-sectional dimension, however, still is within the range given above for typical circular lines.

The packaging of low-cost replacement lines for string trimmer devices typically has been in the form of blister packages on printed paperboard stock. Some packaging operations use folded plastic blister packages or what is known as "clam packs" as an alternative. These folded blister packages are sealed by locking ridges or tabs, which are formed on the two halves of the package.

Originally, the loops or coils of string trimmer line, typically ranging in length from 25' to 50', were wound and then taped or restrained with twist ties or other fastening devices. The taped or restrained coil of trimmer line then was placed in the blister cup; and the cup then was closed (in the case of the folded blister packages) or the cup was sealed to the paperboard backing stock. This method of first coiling the line, then restraining it and placing it into the package proved to be costly to manufacture. In addition, it was less desirable for the end user, since the line had to be completely removed from the package and then either the taped twist tie or other restraining device had to be removed in order to use the line.

For the packaging in the form of blister packages on printed paperboard stock, the flat stock forming the base of the package may be considered as a four-layer sandwich. The base layer is the paperboard stock itself. Then, a thin clay coating is placed over this layer to facilitate the printing of various indicia on the clay coating applied to the stock. After the printing ink has been applied to form the package identification colors and instructions, a thin plastic coating is applied over the printing. The coil of line is placed in the pre-formed PVC blister cup or container, for containing a fixed length coil of trimmer line, then the filled cup is placed on the flat board stock; and heat and pressure is used to seal an outwardly extending flange on the blister to the plastic coated paperboard backing material. Typically, the blister is a cup having circular cross sections. This cup is open on the side which is attached to or sealed to the paperboard backing.

Subsequently, techniques for placing a spiral coiled line inside a package were developed. This provided a lower-cost package, and one that allowed for dispensing the line from the coil without destroying the package. Such products have been supplied for many years. The clamshell blister, however, did not lend itself well to such a dispensing package, particularly for larger sizes of the coiled trimmer line, since the separating force of the coiled line caused the package to open.

Such packaging, however, has been used in the combination of the blister and paperboard package combination. A hole is first formed through the paperboard backing at approximately the center of this cup. Next, trimmer line is wound through the hole in an appropriate length by an automatic or semi-automatic winding machine to fill the blister cup with a desired length of trimmer line after the cup has been sealed to the backing board. The end of the trimmer line then is extended through the hole in the backing; so that it can be withdrawn in a desired amount and cut to length.

The packaging which has been described immediately above is used by many manufacturers of extruded trimmer line for packaging and displaying replacement line for sale. A problem which arises in the use of such packages, however, is that during shipping, handling, storage and display for sale of such trimmer lines, particularly in relatively high humidity climates, the packages open through separation of the flange on the blister pack from one or more of the layers of the paperboard backing. When this occurs, the line in the package then falls out or is exposed; and the damaged package cannot be sold. Efforts to solve the problem of separation of the backing from the blister have not been successful. Part of the reason is that the backing cards generally are manufactured by one manufacturer, the blister is thermoformed by another manufacturer, and the sealing equipment, made by still another manufacturer, is used by the customer packaging the string trimmer line. Each of these parties tends to assign responsibility for the problem to one of the other parties.

The problems may be found in several areas. With respect to the card, separation can result from improper coating, the age of the cards, humidity and temperature. With respect to the blister pack, silicone release on the sealing side may result in an improper seal being effected. Also, forming of the blister at too low a temperature may lead to residual stress in the formed part. The blister, upon sealing, will shrink and this may lead to separation from the card. For the sealing machines, uneven pressure and uneven heat or non-calibrated temperature and pressure control may result in an improper bond being formed. Finally, with respect to the customer assembly to produce the finished package, using the wrong temperature or not enough seal time, or not enough pressure in the use of the sealing machine, also may result in failure of packages.

It is desirable to provide a package particularly suited for packaging coils of replacement string trimmer line which overcomes the disadvantages and problems of the prior art in a simple and effective manner.

SUMMARY OF THE INVENTION

It is an object of this invention to provide an improved method and package for coiled trimmer line.

It is another object of this invention to provide an improved method and package for coiled nylon copolymer trimmer line.

It is an additional object of this invention to provide an improved package for coiled trimmer line which does not separate after the package has been filled with a coil of trimmer line.

In a preferred embodiment of this invention, a method and package for coiled trimmer line is achieved by a pre-formed open plastic bubble container having an outwardly extending flange about the opening in it. The flange is placed on a flat backing sheet of similar plastic material; and the flange is melt bonded to the flat backing sheet prior to the placement of a fixed length of coiled trimmer line in the bubble container.

BRIEF DESCRIPTION OF THE DRAWINGS

FIG. 1 is a perspective view of a prior art package;

FIG. 2 is a cross-sectional view of the package shown in FIG. 1;

FIG. 3 is an enlarged view of a portion of the package of FIG. 2;

FIG. 4 is a perspective view of a preferred embodiment of the invention;

DETAILED DESCRIPTION

Figure 6:
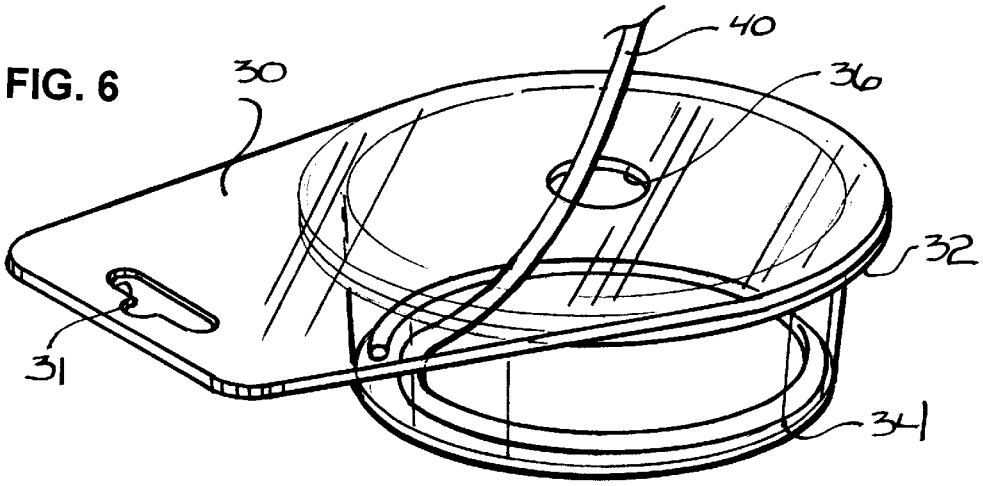
FIG. 6 is a rear perspective view of the package shown in FIG. 4 illustrating the manner of initial filling of the package.

Reference now should be made to the drawings, in which the same reference numbers are used to designate the same or similar components throughout the different figures. FIG. 1 is a front perspective view of a typical prior art package of the type used for displaying and selling coiled nylon copolymer trimmer line and other components. The package shown in FIG. 1 includes a flat backing sheet 10 having a PVC (or PET or other plastic) blister consisting of a bubble or container portion 14 and a rectangular or circular flange 12. The flange 12 is secured to the flat backing sheet 10. An aperture 11 is used to permit hanging the package for display on a horizontal rod. Typically, the package has printing on the backing sheet in the area labeled "indicia" in FIG. 1, as well as on the reverse side of the backing sheet 10, and in some cases, beneath the flange 12 of the PVC bubble.

The bubble 12/14 typically is made of clear plastic material; so that in the area 12, it acts as a window for any printed material on the backing sheet 10. The area 14 allows potential buyers to view the contents of the bubble prior to making a purchase, without opening the package.

FIGS. 2 and 3 are cross-sectional views of the prior art package shown in FIG. 1. FIG. 3 is an enlarged portion of the backing sheet 10 to show the various components or layers which comprise the backing sheet. Typically, the backing sheet 10 is formed of a paperboard stock 18, comprising the primary component and also constituting the major portion of the thickness of the backing sheet. To facilitate the clear printing of trademarks and other indicia on the face of the backing sheet 10, a clay layer or clay coating 20, usually is applied to the paperboard stock 18. This layer facilitates the application of printing in the form of ink patterns 22. The ink patterns 22 generally are of various colors and may cover all or a portion of the clay coating 20. The backing sheet 10 then is completed by the application of a thin emulsion or solution of plastic coating 24 on the top surface, which faces the blister 12/14.

In the construction of the package for use as a blister pack for coiled string trimmer line, the bubble 12/14 is heat sealed, by the application of heat and pressure, as indicated at the lines A—A, to bond the facing surface of the flange 12 to the plastic layer 24 on the backing sheet 10. This bonding is achieved with standard machinery; and the bond strength is determined by the pressure applied at A—A, as well as by the temperature of the applied heat and the time of application of heat and pressure. For most blister pack applications, the bonding is effected in a relatively short length of time, and remains sufficient for the subsequent display, sale and storage of the material placed within the blister 14 of the blister pack 12/14.

After the package has been formed as described above, it is loaded with a measured length of plastic string trimmer line 40 (typically, nylon or nylon copolymer line) by means of an automatic or semi-automatic feeding machine, which coils the line as it is fed into the bubble 14 through a hole in the backing sheet 10 (not shown in FIGS. 1 to 3) at the center of the bubble 14. When the desired amount of line 40 coiled into the bubble, as indicated in FIG. 2, the line fills the space between the inner surface of the bubble 14 and the facing surface of the backing sheet 10.

Because the line 40 is pulled from a much larger reel (upon which it was placed following extrusion) and is coiled into a relatively small (typically 2" to 4" diameter) bubble, the memory of the coiled and torqued line tends to cause it to act as a compressed coil spring exerting force, as indicated in the direction of the arrows in the cross section of FIG. 2. Depending upon the nature of the seal which has been effected at the points A—A between the flange 12 and the upper surface 24 of the backing sheet 10, as well as the heat and humidity conditions under which the package is transported and stored, it has been found that a tearing or pulling away of the flange 12 from the surface 24, or from the layers 22 and 20 from the base paperboard stock 18, begins to take place at the stress points 26 which are shown in FIG. 2. A small amount of stress here is not a problem. It has been found, however, particularly in relatively warm, humid environments, that sufficient pressure is exerted by the coil spring action of the trimmer line 40 in the package to tear away or pull the flange 12 away from the board 18, either by tearing away a part of the plastic layer 10 at the ink 24 or the clay 22, or tearing the flange 12 directly off the layer 24, depending upon the various conditions which have taken place during the manufacture and storage of the package. This is a problem with respect to string trimmer line, particularly the larger diameter lines which exert a greater compression spring force in the package than the relatively smaller, and therefore less spring-like, line diameters. Enough packages self-destruct through the process mentioned above that this has become a significant problem in this industry.

To determine the separating load which is exerted by the coiled line 40 in the package shown in FIGS. 1, 2 and 3, measurements were made of the force exerted by the wound line immediately following completion of the winding of the desired length, and after five minutes. The reason that there is a spring-like force exerted on the package as described above is that the wound line has approximately one twist per coil, where each coil of line in the package has a length of approximately six to twelve inches. This is approximately one to two twists per foot of the line. It is the uncoiling of the line that presents the separating load, which is indicated by the arrows in the region 40 of FIG. 2. This load is dependent upon the line diameter, its material, the modulus, and the shape of the cross section, as well as the winding radius or diameter within the blister 14 of the package.

In order to determine the force which is applied by line of various diameters in a standard package, a test procedure was developed. Selected samples of line were wound in the test procedure, using standard automatic winding apparatus. Instead of sealing the blister 12/14 to the card 10, however, winding was accomplished by holding the flange 12 on the blister cup 14 to the card surface, allowing for separation (that is, free movement during subsequent testing). Next, the sample was placed in a fixture which consisted of a fixed top spaced a precise distance from an accurate (±0.0025 pounds) scale. The distance was set to be approximately 0.005 inches greater than the combined height of the card 10 plus the height of the blister 14. The weight of the card, plus the blister, was then tared to zero on the scale, thus compensating for the weights of the package. The weight of the line was determined; and this also was subtracted from the total separating force exhibited by the coiled line. The measurement on the scale then indicated the readout of the separating force for the line. The force exerted on a one and one-eighth inch deep blister (the distance from the surface of the backing sheet 10 and the interior of the blister 14) for different sizes of line, at different lengths, produced the following results for three different types of line, at five different diameters for each type, for both the winding force immediately after loading of the line in the blister 14 (starting) and the force applied after five minutes. The results are shown in Table 1 below.

TABLE 1

| WINDING FORCE STUDY<br>WINDING FORCE - LOAD (LBS) | | | | | |
|---|---|---|---|---|---|
| LENGTH | 50 FT. | 50 FT. | 40 FT. | 30 FT. | 25 FT. |
| SIZE | 0.065 | 0.080 | 0.095 | 0.105 | 0.130 |
| PT-305 - START | 0.150 | 0.300 | 0.750 | 1.300 | 2.250 |
| CT-500 - START | 0.100 | 0.300 | 0.550 | 0.550 | 1.150 |
| CT-950 - START | 0.200 | 0.600 | 3.900 | 2.900 | 8.900 |
| SIZE | 0.065 | 0.080 | 0.095 | 0.105 | 0.130 |
| PT-305 - 5 MIN. | 0.060 | 0.260 | 0.700 | 1.000 | 2.050 |
| CT-500 - 5 MIN. | 0.100 | 0.300 | 0.500 | 0.550 | 1.000 |
| CT-950 - 5 MIN. | 0.200 | 0.600 | 3.400 | 2.500 | 1.650 |

Next, a test of the ultimate strength of the seam of a plastic blister cup, sealed by means of the flange 10 to a paperboard composite backing sheet of the type described above in conjunction with FIGS. 2 and 3, was made. Both water soluble coatings and solvent coatings for the backing sheets 10 were tested; and a broad range of results was attained for the separating load results.

To determine the shearing force necessary to create a shearing or tearing at the points 26, a jig was arranged which pulled the blister 14 upward relative to the backing sheet 10, as shown in FIG. 2. Package samples were prepared from three different card sources, from various lots, as shown in Table 2 below:

TABLE 2

| | Card | Coating | | Purchase | Age | Sealed # of Units | | | Observation 70 days after seal |
|---|---|---|---|---|---|---|---|---|---|
| Sample | Source | Mfg | Type | Date | (Approx) | Empty | Filled | Total | # Releasing |
| D-1 | A | X | water | 3/97 | 18 mos | 3 | 5 | 8 | 5 |
| D-2 | A | Y | water | 3/98 | 6 mos | 3 | 4 | 7 | 1 |
| D-3 | A | X | water | 7/96 | 31 mos | 3 | 5 | 8 | 5** |
| D-4 | B | Unk. | Unk. | 12/97 | 9 mos | 3 | 5 | 8 | 2 |
| G-1 | A | X | water | 6/96 | 30 mos | 3 | 4 | 7 | 0 |
| G-2 | A | X | water | 11/96 | 22 mos | 3 | 5 | 8 | 0 |
| G-3 | A | Y | water | 7/98 | 2 mos | 3 | 5 | 8 | 0 |
| ST-1 | A | X | water | 7/94 | 50 mos | 3 | 5 | 8 | 2 |
| ST-2 | B | Unk | Unk | 6/98 | 3 mos | 3 | 5 | 8 | 3 |
| CY-2 | B | Unk | Unk | 12/97 | 9 mos | 3 | 5 | 8 | 4 |
| W-1 | C | Y | solvent | 9/98 | 0 mos | 3 | 3 | 6 | 1 |

**completely separated from card

All cards were sealed using the same lot of Blisters (4"1D with a ⅜" flange). Four sealing positions were used on a platen type sealer by Sunwest Plastic Machinery. Sealing pressure was checked to be 80 PSI, seal time was 2.5 seconds, and seal temperature of all positions was measured by heat strip tape to be 190° to 200° F. Cards were sealed consecutively by the same operator within a thirty minute period. Winding took place 24 hours after sealing. Sealing on all cards appeared adequate. No separation was visible. As can be seen from Table 2, no correlation as to age of card, type of ink, source of card or type of coating could be made as relates to release. The ultimate bond strength of such packages immediately after sealing the packages together in the manner described above, varied from a low of 13.1 pounds to a high of 22.2 pounds. The separating force for two different folded clam blister packages tested were found to be much lower, namely 5.5 pounds and 9.0 pounds, respectively.

It can be seen from an examination of Table 1 that, particularly for large diameter line (and especially the line designation CT-950), the initial spring force applied by the line to the package (tending to force the parts apart) is a significant percentage of the separating load results for these packages. For example, the starting load or spring load for the CT-950 line at a 25 foot load was 8.900 pounds. For the worst case of the separating load results of the paperboard composite backed packages which were measured, this amounts to approximately 68% of the ultimate separating load. Even for the best cases, the separating force exerted by the line contained within the device is greater than 33%. For the plastic "clam" containers, the coil spring force of the CT-950 noted above exceeds the restraining force of the package. This is in the ideal starting conditions. Clearly, if moisture affects the bonding of the plastic layer 24 to the base paperboard 18, by way of the ink 24 or clay 22, a much lower separating strength occurs. This in fact is what has been found to happen in the marketplace.

In order to overcome the disadvantages of the prior art package shown in FIGS. 1, 2 and 3 and described above, the package of FIGS. 4, 5, 6 and 8 has been designed. This package includes a PVC, PET or other acceptable plastic blister 34 having a flange 32 on it. The blister 34 is comparable to the blister 14 of the prior art package of FIG. 1; and the flange 32, which extends outwardly from the open or bottom end of the blister 34 is comparable to the flange 12. The paperboard backing sheet, however, has been eliminated. In its place, a clear, flat plastic backing sheet 30, made of the same or a similar material as the blister 32/34 is provided.

Figure 5:
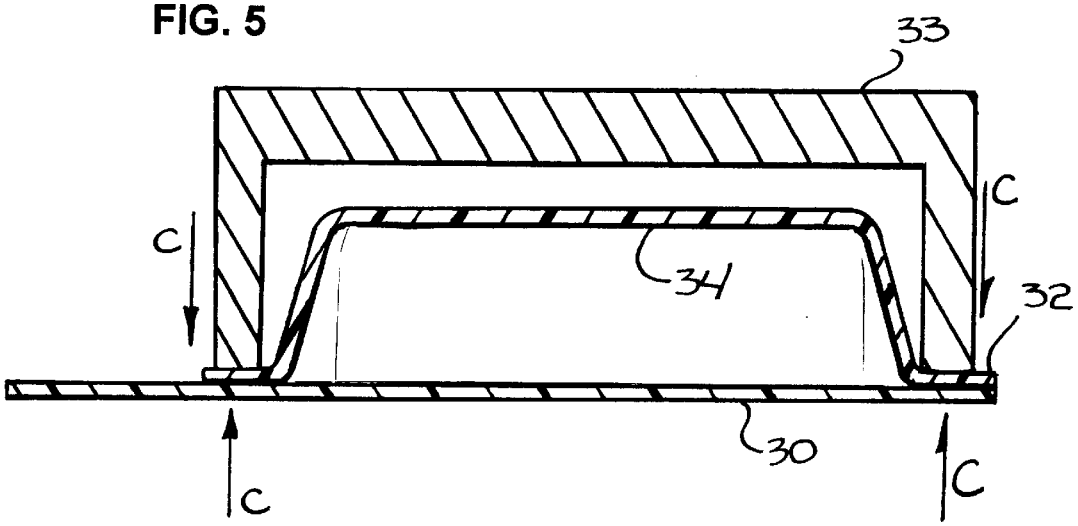
FIG. 5 is a cross-sectional view illustrating the manner of manufacturing the embodiment of FIG. 4.

The sheet 30 then is bonded to the flange 32 by the application of heat and pressure at C—C, as shown in FIG. 5, by means of a standard bonding machine 33. The heat and pressure supplied are sufficient to melt-bond or fuse the flange 32 integrally into the backing sheet 30 to form an extremely strong bond between the blister 32/34 and the plastic backing sheet 30. The fusing or bonding of the flange 32 to the sheet 30 also may be effected by other techniques, such as ultrasonic welding. The manner in which the melting of the plastic in the region of the flange 32 to the backing 30 is effected is not important, so long as sufficient pressure, heat, temperature or other parameters are utilized to effect a melt bonding of the flange 32 to the backing sheet 30.

Figure 7:
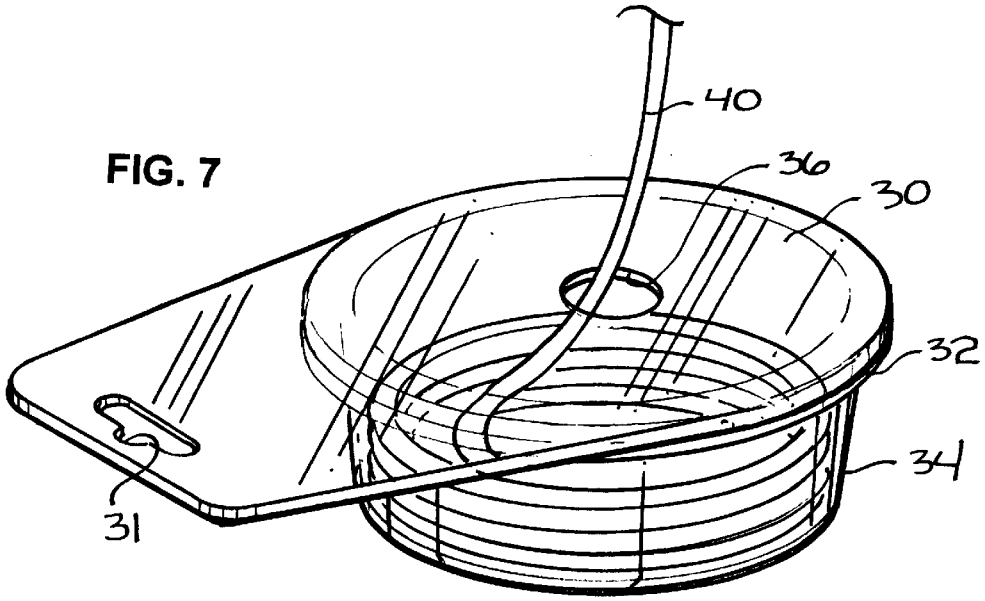
FIG. 7 is a rear perspective view similar to FIG. 6 showing a nearly completed filling of the package.

Once the package has been completed, utilizing the technique shown in FIG. 5, it then is filled with string trimmer line 40 through an aperture 36 in the plastic backing sheet 30, in the manner illustrated in FIG. 6. This is effected by an automatic winding machine to feed the line 40 into a spiral coil, as indicated in FIG. 6. FIG. 7 indicates a greater amount of the line coiled in the package; and when the package is filled with the desired length of line (in the manner shown in FIG. 2), the line 40 is cut. The full package, as shown in FIG. 4, results.

In contrast to the relatively low separating forces which are required to separate the bubble 12/14 from the backing sheet 10 of the prior art package, a comparable test for the package shown in FIGS. 5, 6 and 7 resulted in measured ultimate bond strengths of 103 pounds, 87 pounds and 94 pounds for three different types of PVC material. It further should be noted that the breaking or tearing of the bubble from the backing sheet 30 for a package constructed as described above in conjunction with FIGS. 4, 5, 6 and 7, did not occur along the bonded area of the flange 32 with the backing sheet 30; but rather, the separating breakage occurred in the plastic material of the bubble 34 or the backing sheet 30, respectively. The package shown in FIGS. 4, 5, 6 and 7 also does not deteriorate with age or moisture. No separating of different layers takes place. Humidity does not have an effect on the package; and as long as the surrounding temperature is less than the heat melting temperature of the thermoplastic material out of which the parts 32/34 and 30 are made, heat does not have any effect on the package. Since the fusion heat or melting heat of the materials used for the sheet 30 and the flange 32 and the bubble 34 typically is far in excess of ambient temperatures which are encountered by the package, heat is not a factor in any package deterioration.

In summary, the package of FIGS. 4, 5, 6 and 7 solves the problem which existed in the prior art packages of FIGS. 1 through 3. The package does not come apart, even though a substantial force may be exerted by the nylon or nylon copolymer string trimmer line 40 placed in the package and coiled inside it. It should be noted that the winding forces (spring forces) which have been shown above in Table 1 are a fraction of the overall percentage of the ultimate bond strength of the package, typically 10% instead of the 30% to 68% mentioned above in conjunction with the embodiment of the prior art shown in FIGS. 1 through 3.

The foregoing description of the preferred embodiment of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A method of packaging coiled plastic trimmer line including the steps of:

placing a pre-formed plastic container having an opening, with an outwardly-extending flange about the opening thereof, on a backing sheet of plastic material having an aperture formed therein, with the flange of said pre-formed plastic container engaging the sheet;

heat-bonding the flange of the pre-formed plastic container to the backing sheet to form a melt seal of the flange with the backing sheet; and winding plastic trimmer line having a range of diameter from 0.050" to 0.155" through said aperture into said opening of the pre-formed plastic container into a coil, having approximately one twist per coil, after the flange thereof is bonded to the backing sheet.

2. The method according to claim 1 wherein the pre-formed plastic container and the backing sheet are made of thermoplastic material, and wherein the step of bonding comprises the step of melting together, under pressure, the plastic material of the flange and the region of the backing sheet contacted by the flange to cause a melt-fusion of the flange with the sheet.

3. The method according to claim 1 wherein the bonding of the flange of the pre-formed plastic container to the backing sheet is effected by ultrasonic welding.

4. The method according to claim 1 wherein the step of bonding the flange of the pre-formed plastic container to the backing sheet is effected by the application of heat and pressure between the flange and the backing sheet to cause a melt seal of the plastic of the flange with the plastic of the backing sheet.

* * * * *